US005162033A

United States Patent [19]

Wakabayashi et al.

[11] Patent Number: 5,162,033

[45] Date of Patent: Nov. 10, 1992

[54] BLANK FEEDER

[75] Inventors: Shigeru Wakabayashi; Kazuo Abe; Yasuji Fujikawa, all of Tokushima, Japan

[73] Assignee: Shikoku Kakoki Co., Ltd., Tokushima, Japan

[21] Appl. No.: 804,642

[22] Filed: Dec. 10, 1991

[30] Foreign Application Priority Data

Dec. 14, 1990 [JP] Japan ..... 2-400673[U]

[51] Int. Cl.[5] ..... B31B 5/06; B31B 3/78

[52] U.S. Cl. ..... 493/313; 493/122; 493/164; 493/316

[58] Field of Search ..... 493/122, 123, 124, 125, 493/126, 127, 164, 309, 313, 316

[56] References Cited

U.S. PATENT DOCUMENTS 3,418,894 12/1968 Jivoin ..... 493/309
4,708,707 11/1987 Koike et al. ..... 493/313
5,007,889 4/1991 Wakabayashi et al. ..... 493/316

*Primary Examiner*—William E. Terrell
*Attorney, Agent, or Firm*—Armstrong & Kubovcik

[57] ABSTRACT

A blank feeder has a pair of guide rails for guiding blanks having a tubular form of square cross section to a bottom forming mandrel. The guide rails are formed with opposed recessed portions which are V-shaped in cross section for holding therebetween two corners of the blank on a diagonal thereof, and have shock absorbing means for mitigating the impact to be involved in the stiking contact of the blank with the guide rails.

3 Claims, 7 Drawing Sheets

BLANK FEEDER

BACKGROUND OF THE INVENTION

The present invention relates to a device for feeding blanks to a bottom forming mandrel after opening each of the blanks from a flat form to a tubular form of square cross section.

Already known as such devices are those which comprise a magazine for accommodating flat blanks therein, transport means for withdrawing each of the blanks from the magazine and transporting the blank to a position on a phantom line extending outward from a mandrel, means for opening the flat blank to a tubular form of square cross section while the blank is being transported by the transport means, and a pair of guide rails for receiving the opened blank from the opening means and guiding the blank to the mandrel, the pair of guide rails having opposed recessed portions V-shaped in cross section for holding therebetween two corners of the blank on a diagonal thereof.

With the above device, the blank produces a great noise due to a repulsive force thereof upon the blank coming into striking contact with the guide rail when received by the guide rails. This noise is higher than any other noise released from packaging machines in noise level, whereas no measure has heretofore been taken to reduce the noise.

SUMMARY OF THE INVENTION

The main object of the present invention is to provide a blank feeder which is reduced in noise.

The present invention provides a blank feeder which is of the same type as the conventional device described above and which is characterized in that the recessed portion of at least one of the guide rails is formed in its bottom with a relief space for precluding a corner edge of the blank from striking against the guide rail.

Instead of the relief space, the distance between the recessed portions of the guide rails may be made greater than the distance between the corresponding two corners of the blank of square cross section to be fitted around the mandrel, at a location where the guide rails receive the blank from the opening means.

Further alternatively, at a location where the guide rails receive the blank from the opening means, the distance between the recessed portions of the guide rails may be gradually decreased longitudinally of the guide rails.

When the recessed portion of at least one of the guide rails has the relief space in its bottom, the edge of the corresponding corner of the blank having a high paper strength will not strike against the guide rail when the guide rails receive the blank.

Further when the distance between the recessed portions is greater than the distance between the corresponding two corners of the blank of square cross section at the location where the guide rails receive the blank from the opening means, the blank is not in a square cross sectional form which exerts a great repulsive force but is made lower in repulsive force by being slightly deformed flat to a rhombic form from the square cross section when to be received by the guide rails.

Further if the distance between the recessed portions of the guide rails is gradually decreased longitudinally of the guide rails at the location where the guide rails receive the blank from the opening means, the blank comes into contact with the guide rails not over the entire length of the blank but only at one blank end portion when to be received by the guide rails.

Thus, when the blank is to be received by the guide rails, the blank corner edge having a high paper strength does not strike against the rail, or the blank is slightly flat and rhombic in cross section and lower in repulsive force than when in a square cross section, or the blank comes into contact with the guide rails not over the entire length but only at one blank end. In any case, therefore, the noise to be produced when the blank is received by the guide rails can be diminished.

DESCRIPTION OF THE PREFERRED EMBODIMENTS

Embodiments of the invention will be described next with reference to the drawings.

EMBODIMENT 1

Figure 1:
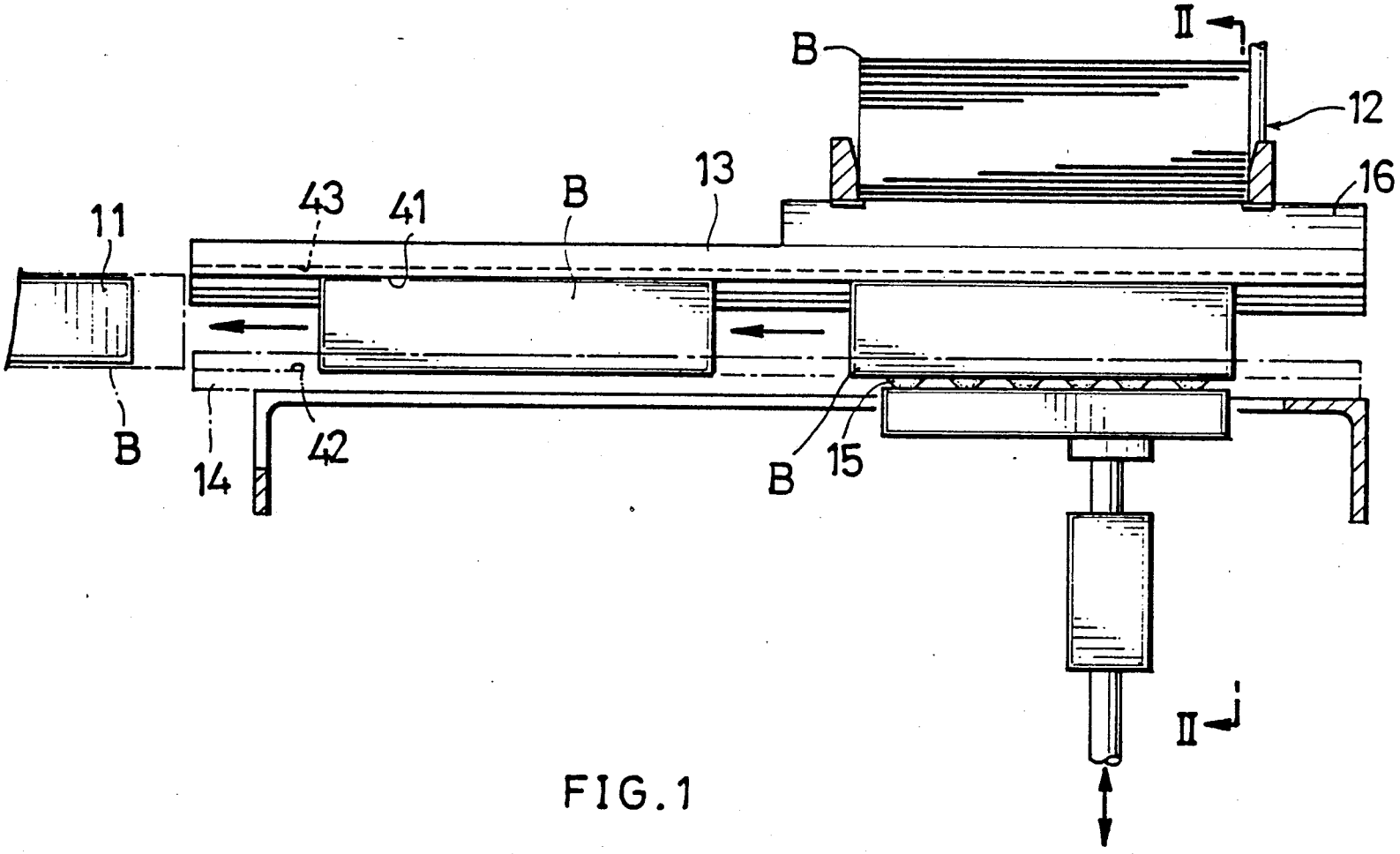
FIG. 1 is a side elevation of a blank feeder as an embodiment 1.
Figure 2:
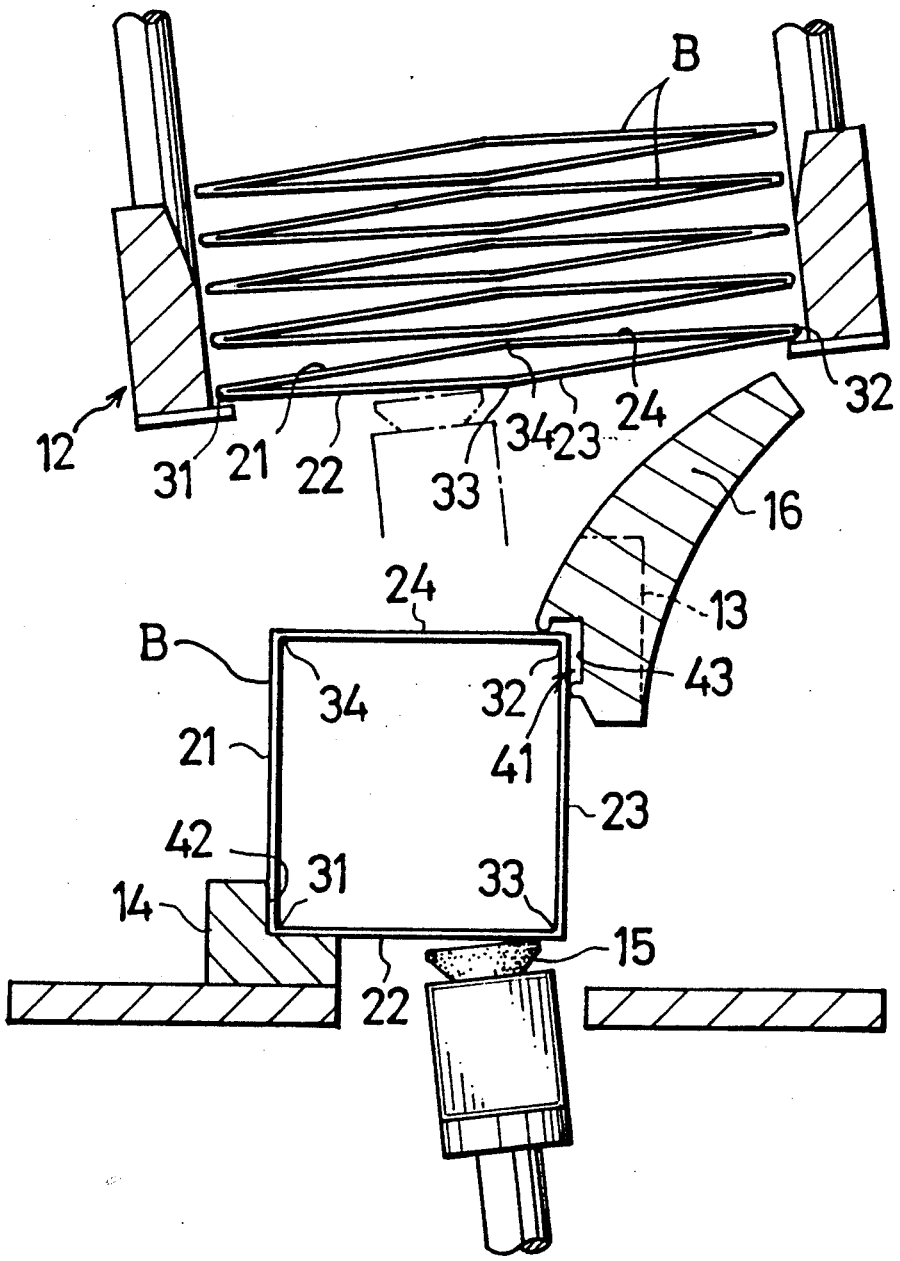
FIG. 2 is a view in section taken along the line II—II in FIG. 1.
Figure 3:
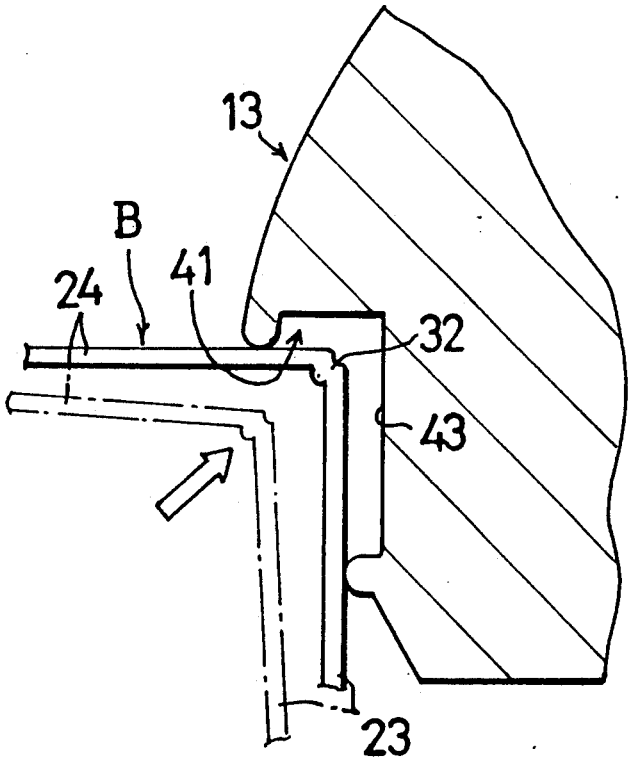
FIG. 3 is an enlarged fragmentary view in section of the embodiment 1.

With reference to FIGS. 1 to 3 showing a blank feeder as an embodiment 1, the feeder comprises a magazine 12 disposed obliquely above an extension of the axis of a blank forming mandrel 11, a pair of upper and lower guide rails 13, 14 extending in parallel to the extension on opposite sides thereof, a suction member 15 movable between the guide rails 13, 14 toward or away from the magazine 12, and a bending guide 16 extending from the upper guide rail 13 toward the magazine 12.

The magazine 12 accommodates therein a multiplicity of blanks B as stacked up. Each blank B within the magazine 12 is folded flat by being bent along a first score 31 for defining a first side panel 21 and a second side panel 22 and along a second score 32 defining a third side panel 23 and a fourth side panel 24, with the second and third side panels 22, 23 facing downward toward a delivery opening. The suction member 15 holds attracted thereto the second side panel 22 of the blank B at the lowermost position within the magazine 12 and transports the blank B to the guide rails 13, 14 along a path orthogonal to the second side panel 22. The bending guide 16 unfolds or opens the blank B being transported by the suction member 15 from the flat form to a tubular form of square cross section by guiding the blank portion of the second score 33 toward the portion of the first score 31 and bending the blank B along a third score 33 defining the second side panel 22 and the third side panel 23 and along a fourth score 34 defining the fourth side panel 24 and the first side panel 21.

The guide rails 13, 14 have opposed recessed portions 41, 42 V-shaped in cross section and conforming respectively to the corner portions at the first and second scores 31, 32 on a diagonal of the blank B in the form of a tube of square cross section. The recessed portion 41 of the upper guide rail 13 is formed with a relief space 43 except at its opening edge, whereby the corner edge along the second score 32 is precluded from striking against the upper guide rail 13.

With the above embodiment, the relief space 43 is formed only in the upper guide rail 13, whereas each of the guide rails 13, 14 may of course be provided with the relief space. When the relief space is to be provided in only one of the guide rails 13, 14, it is more advantageous that the upper guide rail 13 be formed with the space because the blank B gives off a great noise upon the portion of the second score 32 moving over the upper guide rail 13 when the blank B is to be held by the guide rails 13.

The noise production mechanism will be described in greater detail with reference to FIG. 3. First, the portion of the second score 32 of the blank B gives off a noise upon striking against the side face, facing to the left, of the recessed portion 41 when moving over the upper opening edge of the recessed portion 41. Subsequently, the blank B is pulled down as attacted to the suction member 15 to the position indicated in broken lines in FIG. 3, where the blank is released from the suction member 15, whereupon the repulsive force of the blank B acts to bring the blank to the solid-line position in FIG. 3. The portion of the second score 32 of the blank B therefore comes into striking contact with the side face of the recessed portion 41 facing downward to produce a noise. If the recessed portion 41 had no relief space 43, the corner edge along the second score 32 would strike against the side face of the recessed portion 41, consequently producing a considerably great noise, whereas the presence of the relief space 43 precludes the corner edge from striking against the side face of the recessed portion 41. This considerably attenuates the noise to be given off.

EMBODIMENT 2

Figure 4:
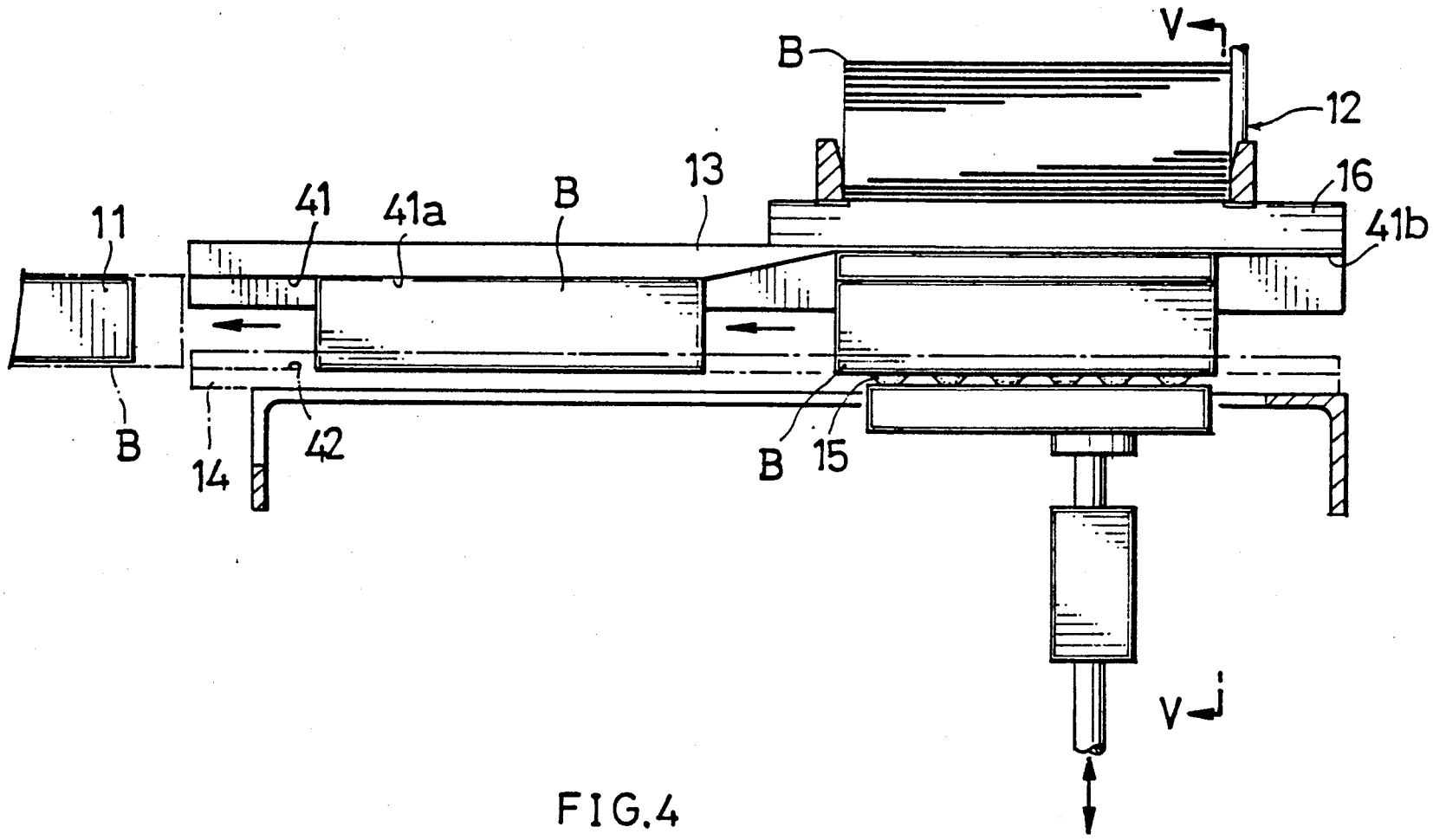
FIG. 4 is a side elevation of another blank feeder as an embodiment 2.
Figure 5:
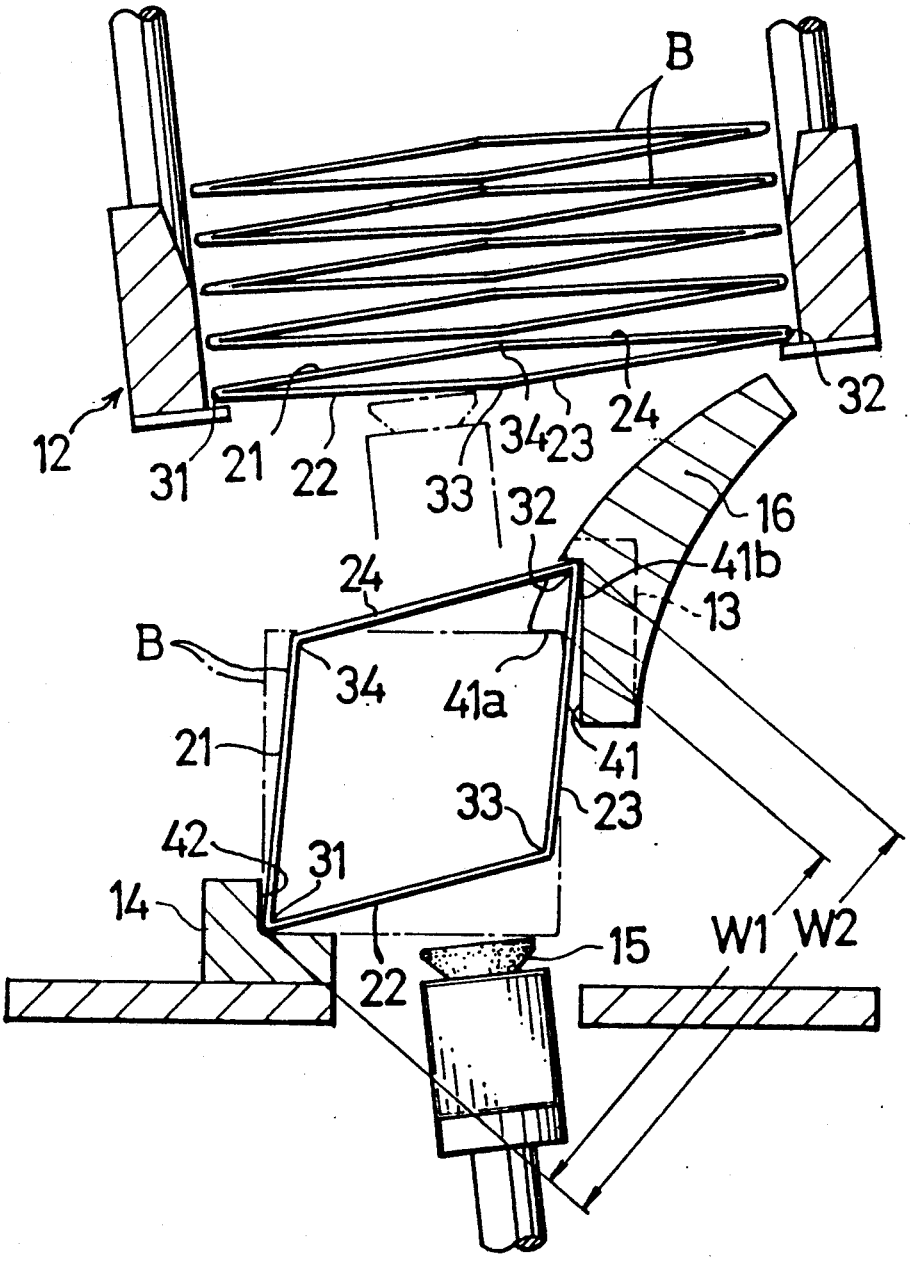
FIG. 5 is a view in section taken along the line IV—IV in FIG. 4.

With reference to FIGS. 4 and 5 showing another blank feeder as an embodiment 2, the feeder comprises, like the embodiment 1, a magazine 12 disposed obliquely above an extension of the axis of a blank forming mandrel 11, a pair of upper and lower guide rails 13, 14 extending in parallel to the extension on opposite sides thereof, a suction member 15 movable between the guide rails 13, 14 toward or away from the magazine 12, and a bending guide 16 extending from the upper guide rail 13 toward the magazine 12.

The embodiment 2 is the same as the embodiment 1 with respect to the basic construction of the magazine 12, guide rails 13, 14, suction member 15 and bending guide 16, which therefore will not be described again.

As in the embodiment 1, the guide rails 13, 14 are formed with opposed recessed portions 41, 42 . The recessed portion 41 of the upper guide rail 13 comprises an inner shallow part **41*a* and an outer deep part 41*b* which are positioned on opposite sides of approximate midpoint of its length. The distance W1 between the shallow recessed part 41*a* and the recessed portion 42 of the two guide rails 13, 14 is equal to the distance between the two corners on the corresponding diagonal of the blank B which is square in cross section. The distance W2 between the deep recessed part 41*b* and the recessed portion 42 of the guide rails 13, 14** is greater than the distance between the two corners on the corresponding diagonal of the blank B.

The blank B is slightly deformed flat to a rhombic form from the square form in cross section when held between the guide rails 13, 14. The repulsive force of the blank B is smaller when the blank B is in the rhombic cross sectional form than when it is square in cross section. The blank B produces a smaller noise when to be held in the rhombic form by the guide rail 13, 14 than when to be thereby held in the square form.

EMBODIMENT 3

Figure 6:
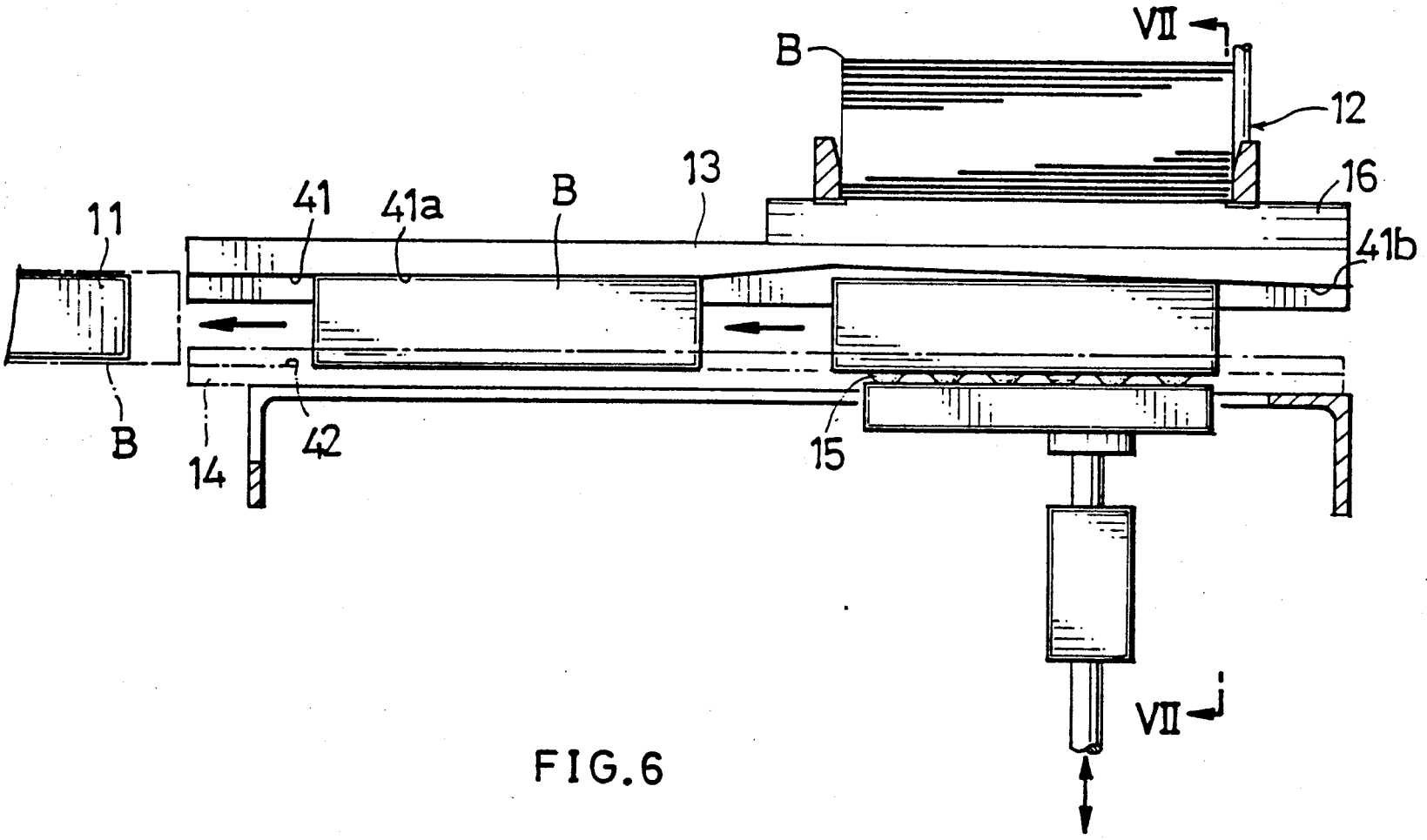
FIG. 6 is a side elevation of another blank feeder as an embodiment 3.
Figure 7:
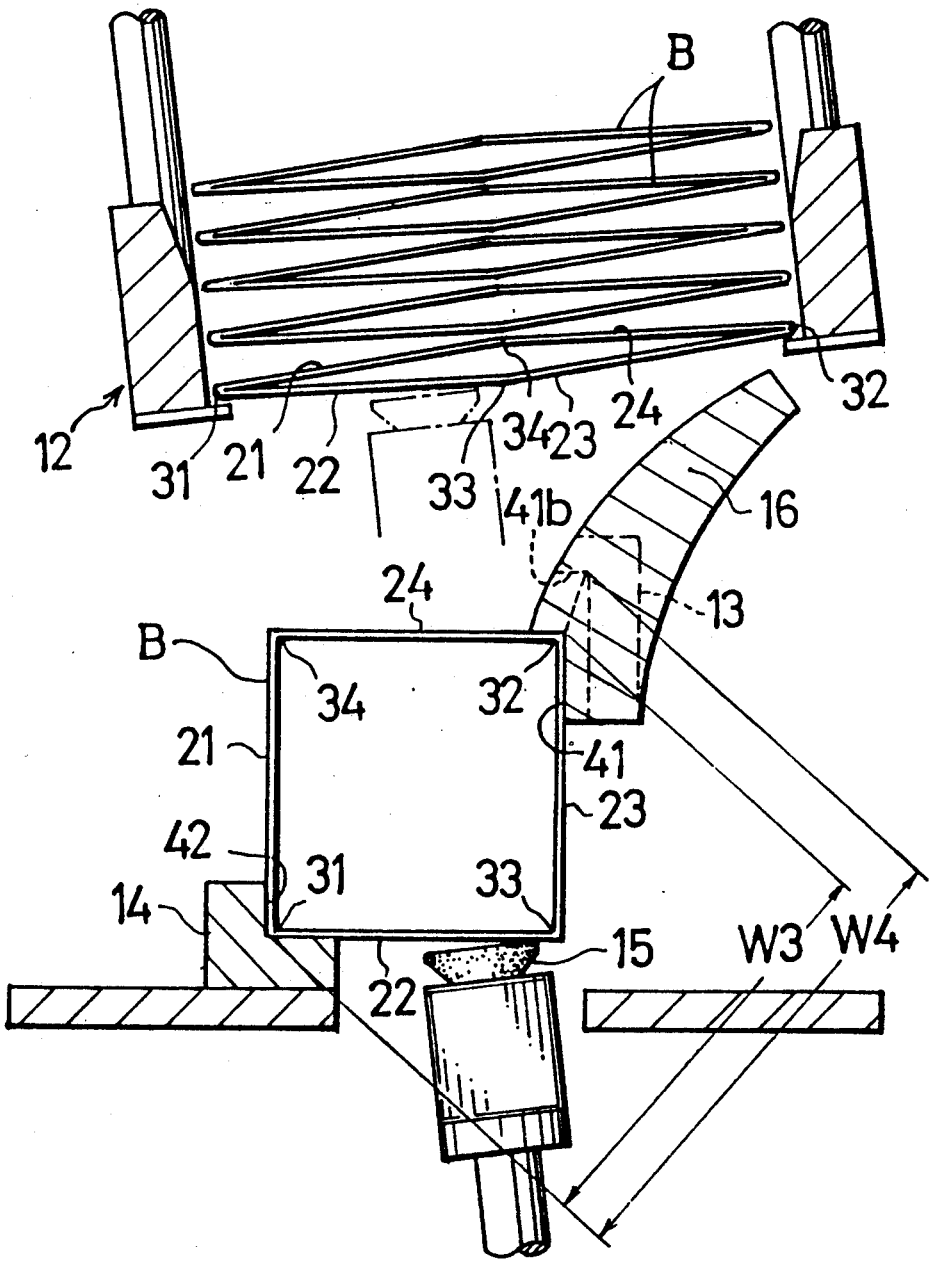
FIG. 7 is a view in section taken along the line VII—VII in FIG. 6.

With reference to FIGS. 6 and 7 showing another blank feeder as an embodiment 3, the feeder comprises, like the embodiment 1, a magazine 12 disposed obliquely above an extension of the axis of a blank forming mandrel 11, a pair of upper and lower guide rails 13, 14 extending in parallel to the extension on opposite sides thereof, a suction member 15 movable between the guide rails 13, 14 toward or away from the magazine 12, and a bending guide 16 extending from the upper guide rail 13 toward the magazine 12.

The embodiment 3 is the same as the embodiment 1 with respect to the basic construction of the magazine 12, guide rails 13, 14, suction member 15 and bending guide 16, which therefore will not be described again.

As in the embodiment 1, the guide rails 13, 14 are formed with opposed recessed portions 41, 42. The recessed portion 41 in the upper guide rail 13 has a depth gradually increasing from the outer end of the rail 13 toward the midpoint of its length. Accordingly, over an inner portion **41*a* of the upper guide rail 13 which portion is inward from the midpoint of its length, the distance W3 between the recessed portions of the guide rails 13, 14 is definite and equal to the distance between the two corners on the corresponding diagonal of the blank B of square cross section, whereas over an outer portion 41*b* of the upper guide rail 13 which portion is outward from the midpoint of its length, the distance W4 between the two guide rails 13, 14 gradually decreases longitudinally of the guide rails 13, 14**.

The blank B is held by the guide rails 13, 14 not over the entire length of the blank but at only outer end thereof. Since the outer end portion only of the blank B strikes against the guide rails 13, 14 when the blank B is to be held by the rails 13, 14, the noise then produced is smaller than when the entire length of the blank B strikes against the guide rails 13, 14.

What is claimed is:

1. A blank feeder for feeding blanks to a bottom forming mandrel by opening each of the blanks from a flat form to a tubular form of square cross section and fitting the opened blank around the mandrel, the feeder comprising:

a magazine for accommodating flat blanks therein, transport means for withdrawing each of the blanks from the magazine and transporting the blank to a position on a phantom line extending outward from the mandrel, means for opening the flat blank to the tubular form of square cross section while the blank is being transported by the transport means, and a pair of guide rails for receiving the opened blank from the opening means and guiding the blank to the mandrel, the pair of guide rails having opposed recessed portions V-shaped in cross section for holding therebetween two corners of the blank on a diagonal thereof, the recessed portion of at least one of the guide rails being formed in its bottom with a relief space for precluding a corner edge of the blank from striking against the guide rail.

2. A blank feeder for feeding blanks to a bottom forming mandrel by opening each of the blanks from a flat form to a tubular form of square cross section and fitting the opened blank around the mandrel, the feeder comprising:

a magazine for accommodating flat blanks therein, transport means for withdrawing each of the blanks from the magazine and transporting the blank to a position on a phantom line extending outward from the mandrel, means for opening the flat blank to the tubular form of square cross section while the blank is being transported by the transport means, and a pair of guide rails for receiving the opened blank from the opening means and guiding the blank to the mandrel, the pair of guide rails having opposed recessed portions V-shaped in cross section for holding therebetween two corners of the blank on a diagonal thereof, the distance between the recessed portions of the guide rails being greater than the distance between the corresponding two corners of the blank of square cross section to be fitted around the mandrel, at a location where the guide rails receive the blank from the opening means.

3. A blank feeder for feeding blanks to a bottom forming mandrel by opening each of the blanks from a flat form to a tubular form of square cross section and fitting the opened blank around the mandrel, the feeder comprising:

a magazine for accommodating flat blanks therein, transport means for withdrawing each of the blanks from the magazine and transporting the blank to a position on a phantom line extending outward from the mandrel, means for opening the flat blank to the tubular form of square cross section while the blank is being transported by the transport means, and a pair of guide rails for receiving the opened blank from the opening means and guiding the blank to the mandrel, the pair of guide rails having opposed recessed portions V-shaped in cross section for holding therebetween two corners of the blank on a diagonal thereof, the distance between the recessed portions of the guide rails being gradually decreased longitudinally of the guide rails at a location where the guide rails receive the blank from the opening means.

* * * * *